US010808487B2

(12) United States Patent
Yousef et al.

(10) Patent No.: US 10,808,487 B2
(45) Date of Patent: Oct. 20, 2020

(54) QUICK DISCONNECT STRIPPER PACKER COUPLING ASSEMBLY

(71) Applicant: Nabors Drilling Technologies USA, Inc., Houston, TX (US)

(72) Inventors: Faisal Yousef, Houston, TX (US); Tommy Vu, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 16/054,969

(22) Filed: Aug. 3, 2018

(65) Prior Publication Data

US 2020/0040686 A1 Feb. 6, 2020

(51) Int. Cl.

| | |
|---|---|
| ***E21B 33/06*** | (2006.01) |
| ***E21B 33/02*** | (2006.01) |
| ***E21B 21/015*** | (2006.01) |
| ***E21B 33/03*** | (2006.01) |
| ***E21B 33/04*** | (2006.01) |

(52) U.S. Cl.

CPC ..... *E21B 33/0415* (2013.01); *E21B 33/06* (2013.01)

(58) Field of Classification Search

CPC ..... E21B 33/0415

See application file for complete search history.

(56) References Cited

U.S. PATENT DOCUMENTS

| | | | | |
|---|---|---|---|---|
| 3,621,912 | A | 11/1971 | Woody, Jr. et al. | |
| 4,363,357 | A | 12/1982 | Hunter | |
| 5,634,671 | A * | 6/1997 | Watkins | E21B 17/085 166/344 |
| 7,165,610 | B2 | 1/2007 | Hopper | |
| 7,174,956 | B2 | 2/2007 | Williams et al. | |
| 7,198,098 | B2 * | 4/2007 | Williams | E21B 33/085 166/84.3 |
| 7,334,633 | B2 | 2/2008 | Williams et al. | |
| 7,726,416 | B2 | 6/2010 | Williams | |
| 7,766,100 | B2 | 8/2010 | Williams | |
| 7,798,210 | B1 * | 9/2010 | Pruitt | E21B 33/085 166/84.1 |
| 7,874,353 | B2 | 1/2011 | Williams | |
| 8,256,507 | B2 | 9/2012 | Williams | |

(Continued)

*Primary Examiner* — Matthew R Buck
*Assistant Examiner* — Douglas S Wood

(57) ABSTRACT

A stripper packer coupling assembly can include a packer operable to receive a tubular therethrough and form a seal about the tubular. The packer can comprise a plurality of coupling protrusions, each having a coupling head defining a first capture interface. Additionally, the stripper packer coupling assembly can include a capture mechanism. The capture mechanism can comprise a guide member having a plurality of guide openings, each operable to receive one of the plurality of coupling heads therein. The capture mechanism can also comprise a plurality of capture members, each defining a second capture interface. Capture members can be operably coupled to one another such that they are simultaneously movable relative to the guide member and the coupling protrusions between a capture position and a release position. In the release position, the capture members can facilitate passage of the coupling heads through the guide openings. In the capture position, the first and second capture interface surfaces engage to mechanically interfere with passage of the coupling heads through the guide openings.

19 Claims, 4 Drawing Sheets

(56) References Cited

U.S. PATENT DOCUMENTS

| | | | |
|---|---|---|---|
| 8,322,432 | B2 | 12/2012 | Bailey et al. |
| 8,991,484 | B2 | 3/2015 | Riggs |
| 9,057,239 | B2 | 6/2015 | Young |
| 9,068,433 | B2 | 6/2015 | Bushman et al. |
| 9,856,713 | B2 | 1/2018 | Tarique et al. |
| 2012/0013133 | A1 | 1/2012 | Rio, III et al. |
| 2014/0238686 | A1 | 8/2014 | Boyd |
| 2016/0123399 | A1 | 5/2016 | Arnt et al. |
| 2016/0258239 | A1 | 9/2016 | Clark |
| 2016/0305213 | A1 | 10/2016 | Godfrey et al. |
| 2019/0093445 | A1 | 3/2019 | Kulkarni et al. |

* cited by examiner

QUICK DISCONNECT STRIPPER PACKER COUPLING ASSEMBLY

BACKGROUND

Well drilling head equipment often includes a stationary component that supports a rotatable spindle (e.g., within a bearing assembly or rotating control device (RCD)) that is rotated during well drilling operations (e.g., by a top drive unit). A seal or packing, often referred to as a "stripper packer" or "stripper rubber," or "packer" can be carried by the rotary spindle. The stripper packer serves to seal the periphery of a tubular or other drill hardware extending through the spindle to confine fluid pressure in a well casing and prevent drilling fluid from escaping between the spindle and the tubular or other drill hardware. A single stripper packer or two stripper packers arranged in series are commonly utilized.

A stripper packer typically includes a tapered, annular seal element made of rubber or other resilient material. A stripper packer often includes a metal insert that provides support for bolts or other attachment or fastening features, which also provides a support structure for the seal element. The seal element is force fit onto a tubular to form a seal. When the seal element is exposed to well bore pressure, further sealing is achieved by annular pressure acting on the seal element (e.g., well pressure actuation). The stripper packer can provide a seal about the tubular as the tubular slides through the stripper packer during well operations. The seal element may rotate with the tubular if the stripper packer is coupled to a rotary spindle.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
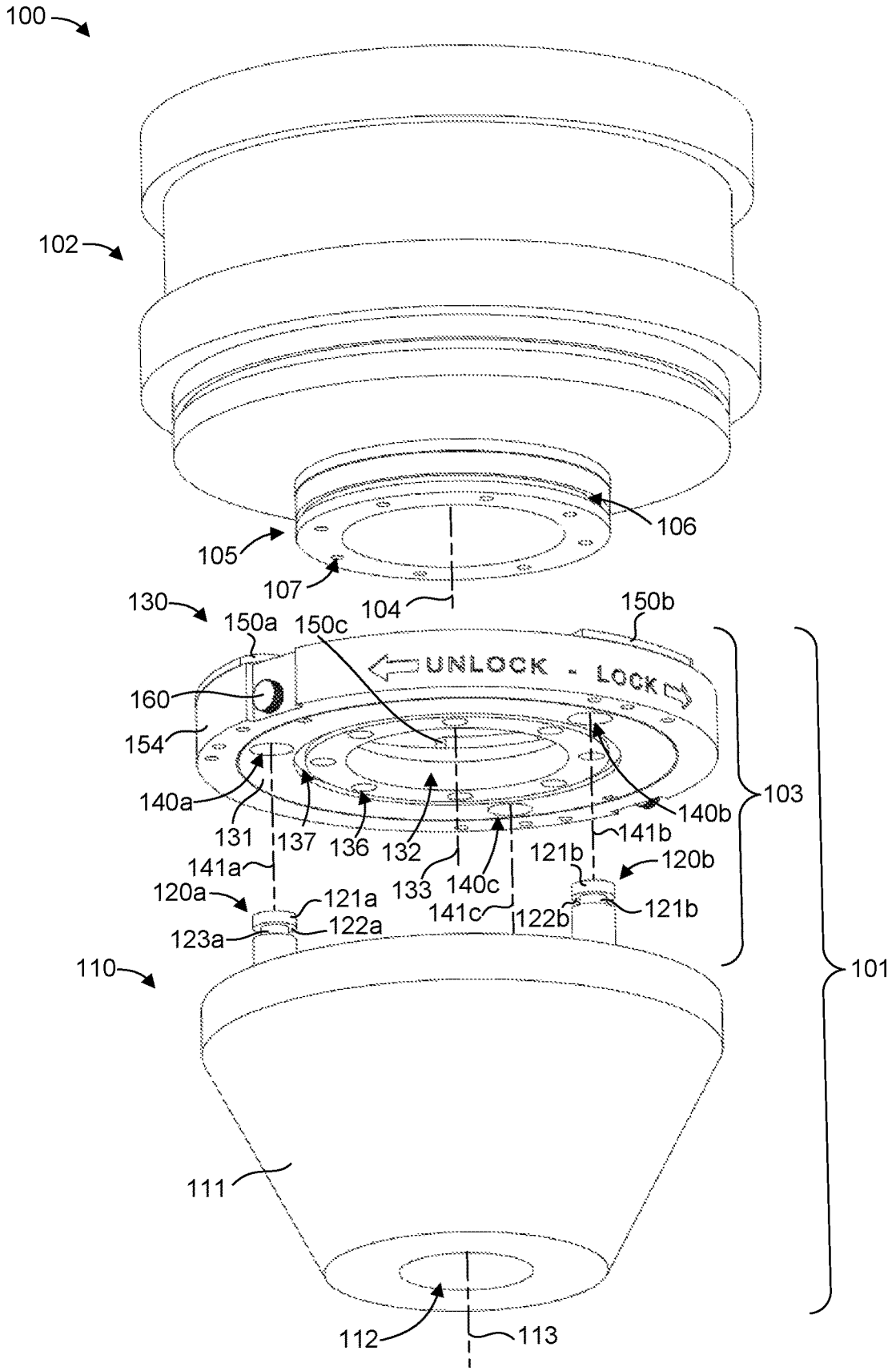
FIG. 1 is an exploded view of a stripper packer system in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

As described above, stripper rubbers or stripper packers are connected to equipment of the drilling head to establish and maintain a pressure seal around a down hole tubular. The stripper packer seal element wears during use due to frequent upward and downward movement of tubulars through the seal element during addition and removal of tubulars and the high pressures to which the drilling head is subjected. In addition, rotation of the drill string can cause the rotary spindle to rotate due to the frictional engagement between the seal element and the tubulars. This subjects the seal member to constant torque loading, which tends to accelerate wear and failure of the seal. The stripper rubbers must therefore be replaced periodically to maintain an effective seal.

Accordingly, a stripper packer coupling assembly is disclosed that provides a reliable, selectively detachable connection between a stripper packer and drilling head equipment. The stripper packer coupling assembly can include a packer operable to receive a tubular therethrough and form a seal about the tubular. The packer can comprise one of a coupling protrusion or a capture mechanism. In addition, the stripper packer coupling assembly can include a well equipment mounting device operable to mount to a well drilling head component and removably couple the packer to the well drilling head component. The well equipment mounting device can comprise the other of the coupling protrusion or the capture mechanism. The coupling protrusion can have a coupling head defining a first capture interface surface. The capture mechanism can comprise a guide member having a guide opening defining a guide opening axis. The guide opening can be operable to receive the coupling head in a direction parallel to the guide opening axis. The capture mechanism can also comprise a capture member defining a second capture interface surface. The capture member can be movable relative to the guide member and the coupling protrusion between a capture position and a release position in a direction excluding rotation about an axis perpendicular to the guide opening axis. In the release position, the capture member can facilitate passage of the coupling head through the guide opening. In the capture position, the second capture interface surface of the capture member can be operable to engage the first capture interface surface of the coupling head to mechanically interfere with passage of the coupling head through the guide opening.

In one aspect, a stripper packer coupling assembly is disclosed that can include a packer operable to receive a tubular therethrough and form a seal about the tubular. The packer can comprise a plurality of coupling protrusions or a capture mechanism. Additionally, the stripper packer coupling assembly can include a well equipment mounting device operable to mount to a well drilling head component and removably couple the packer to the well drilling head component. The well equipment mounting device can comprise the other of the coupling protrusion or the capture mechanism. Each coupling protrusion can have a coupling head defining a first capture interface. The capture mechanism can comprise a guide member having a plurality of guide openings. Each guide opening can be operable to receive one of the plurality of coupling heads therein. The capture mechanism can also comprise a plurality of capture members. Each capture member can define a second capture interface. The plurality of capture members can be operably coupled to one another such that the plurality of capture members are simultaneously movable relative to the guide member and the plurality of coupling protrusions between a capture position and a release position. In the release position, the plurality of capture members can facilitate passage of the plurality of coupling heads through the plurality of guide openings. In the capture position, the second capture interface surfaces of the plurality of capture members can be operable to engage the first capture interface surfaces of the plurality of coupling heads to mechanically interfere with passage of the coupling heads through the guide openings.

In one aspect, a stripper packer coupling assembly is disclosed that can include a packer comprising a tubular opening operable to receive a tubular therethrough and form a seal about the tubular. The tubular opening can define a tubular opening axis. The packer can also comprise a coupling protrusion having a coupling head defining a first capture interface surface. The packer coupling assembly can also include a well equipment mounting device operable to mount to a well drilling head component and removably couple the packer to the well drilling head component. The well equipment mounting device can have a capture mechanism. The capture mechanism can include a guide member having a guide opening operable to receive the coupling head. The capture mechanism can also include a capture ring rotatably coupled to the guide member and rotatable about the tubular opening axis. In addition, the capture mechanism can include a capture member coupled to, and movable with, the capture ring. The capture member can have a second capture interface surface. The capture ring can be operable to rotate the capture member between a capture position and a release position. In the release position, the capture member can facilitate passage of the coupling head through the guide opening. In the capture position, the second capture interface surface of the capture member can be operable to engage the first capture interface surface of the coupling head to mechanically interfere with passage of the coupling head through the guide opening.

In one aspect, a stripper packer system is disclosed that can include a well drilling head component. The stripper packer system can also include a packer operable to receive a tubular therethrough and form a seal about the tubular. The packer can comprise a coupling protrusion or a capture mechanism. Additionally, the stripper packer system can include a well equipment mounting device coupled to the well drilling head component and operable to removably couple the packer to the well drilling head component. The well equipment mounting device can comprise the other of the coupling protrusion or the capture mechanism. The coupling protrusion can have a coupling head defining a first capture interface surface. The capture mechanism can include a guide member having a guide opening defining a guide opening axis. The guide opening can be operable to receive the coupling head in a direction parallel to the guide opening axis. In addition, the capture mechanism can include a capture member defining a second capture interface surface. The capture member can be movable relative to the guide member and the coupling protrusion between a capture position and a release position in a direction excluding rotation about an axis perpendicular to the guide opening axis. In the release position, the capture member can facilitate passage of the coupling head through the guide opening. In the capture position, the second capture interface surface of the capture member can be operable to engage the first capture interface surface of the coupling head to mechanically interfere with passage of the coupling head through the guide opening.

In one aspect, a stripper packer system is disclosed that can include a well drilling head component. The stripper packer system can also include a packer operable to receive a tubular therethrough and form a seal about the tubular. The packer can comprise a plurality of coupling protrusions or a capture mechanism. In addition, the stripper packer system can include a well equipment mounting device coupled to the well drilling head component and operable to removably couple the packer to the well drilling head component. The well equipment mounting device can comprise the other of the coupling protrusion or the capture mechanism. Each coupling protrusion can have a coupling head defining a first capture interface. The capture mechanism can include a guide member having a plurality of guide openings. Each guide opening can be operable to receive one of the plurality of coupling heads therein. Additionally, the capture mechanism can include a plurality of capture members. Each capture member can define a second capture interface. The plurality of capture members can be operably coupled to one another such that the plurality of capture members are simultaneously movable relative to the guide member and the plurality of coupling protrusions between a capture position and a release position. In the release position, the plurality of capture members can facilitate passage of the plurality of coupling heads through the plurality of guide openings. In the capture position, the second capture interface surfaces of the plurality of capture members can be operable to engage the first capture interface surfaces of the plurality of coupling heads to mechanically interfere with passage of the coupling heads through the guide openings.

In one aspect, a connector is disclosed for selectively connecting a stripper packer to well drilling head equipment. The connector can include a coupling protrusion having a coupling head defining a first capture interface surface. In addition, the connector can include a capture mechanism. The capture mechanism can include a guide member having a guide opening defining a guide opening axis. The guide opening can be operable to receive the coupling head in a direction parallel to the guide opening axis. Additionally, the capture mechanism can include a capture member defining a second capture interface surface. The capture member can be movable relative to the guide member and the coupling protrusion between a capture position and a release position in a direction excluding rotation about an axis perpendicular to the guide opening axis. In the release position, the capture member can facilitate passage of the coupling head through the guide opening. In the capture position, the second capture interface surface of the capture member can be operable to engage the first capture interface surface of the coupling head to mechanically interfere with passage of the coupling head through the guide opening.

In one aspect, a connector is disclosed for selectively connecting a stripper packer to well drilling head equipment. The connector can include a plurality of coupling protrusions. Each coupling protrusion can have a coupling head defining a first capture interface. Additionally, the connector can include a capture mechanism. The capture mechanism can include a guide member having a plurality of guide openings. Each guide opening can be operable to receive one of the plurality of coupling heads therein. In addition, the capture mechanism can include a plurality of capture members. Each capture member can define a second capture interface. The plurality of capture members can be operably coupled to one another such that the plurality of capture members are simultaneously movable relative to the guide member and the plurality of coupling protrusions between a capture position and a release position. In the release position, the plurality of capture members can facilitate passage of the plurality of coupling heads through the plurality of guide openings. In the capture position, the second capture interface surfaces of the plurality of capture members can be operable to engage the first capture interface surfaces of the plurality of coupling heads to mechanically interfere with passage of the coupling heads through the guide openings.

Figure 2:
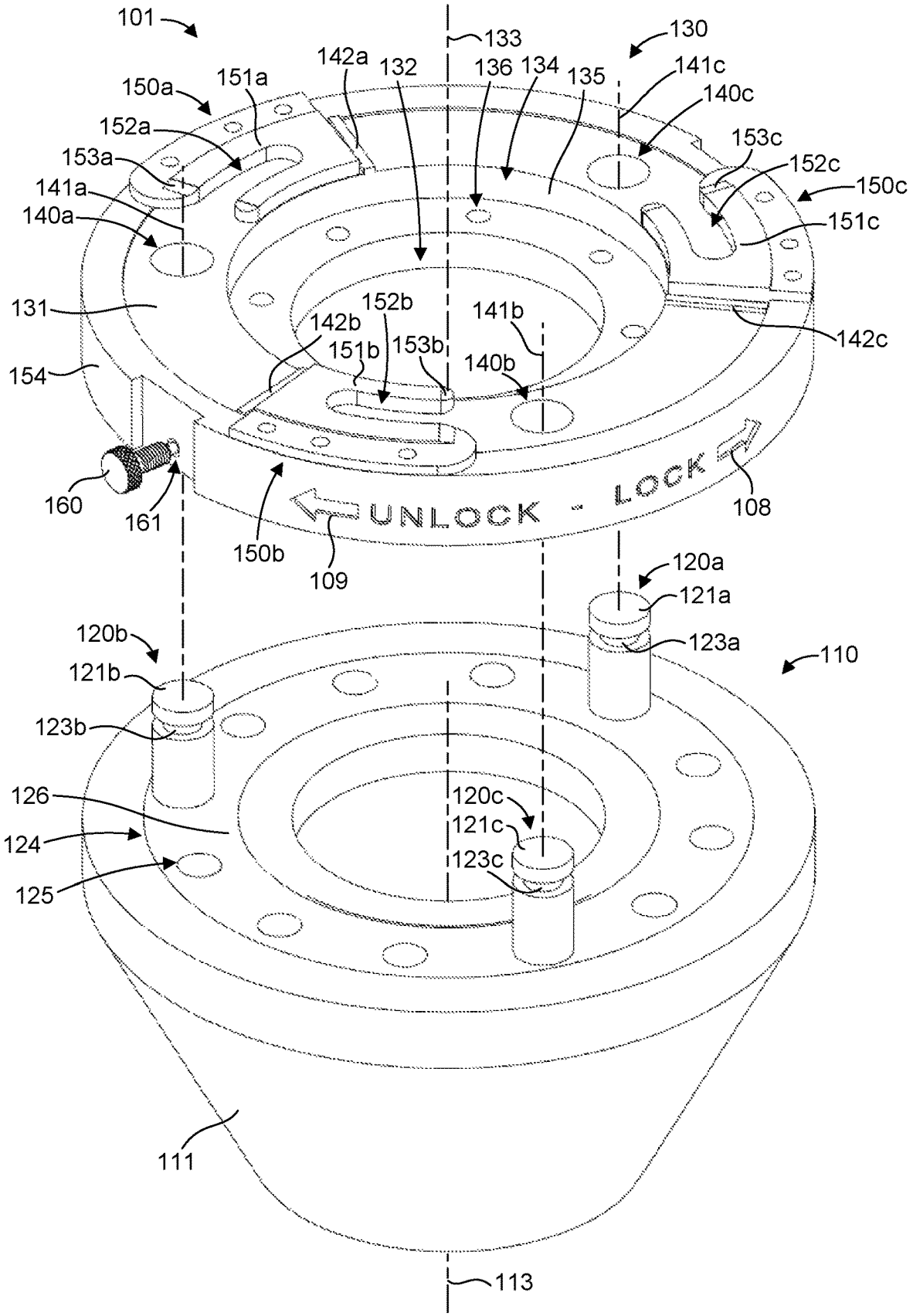
FIG. 2 is an exploded view of a stripper packer coupling assembly of the stripper packer system of FIG. 1 shown in a release position in accordance with an example of the present disclosure.
Figure 3:
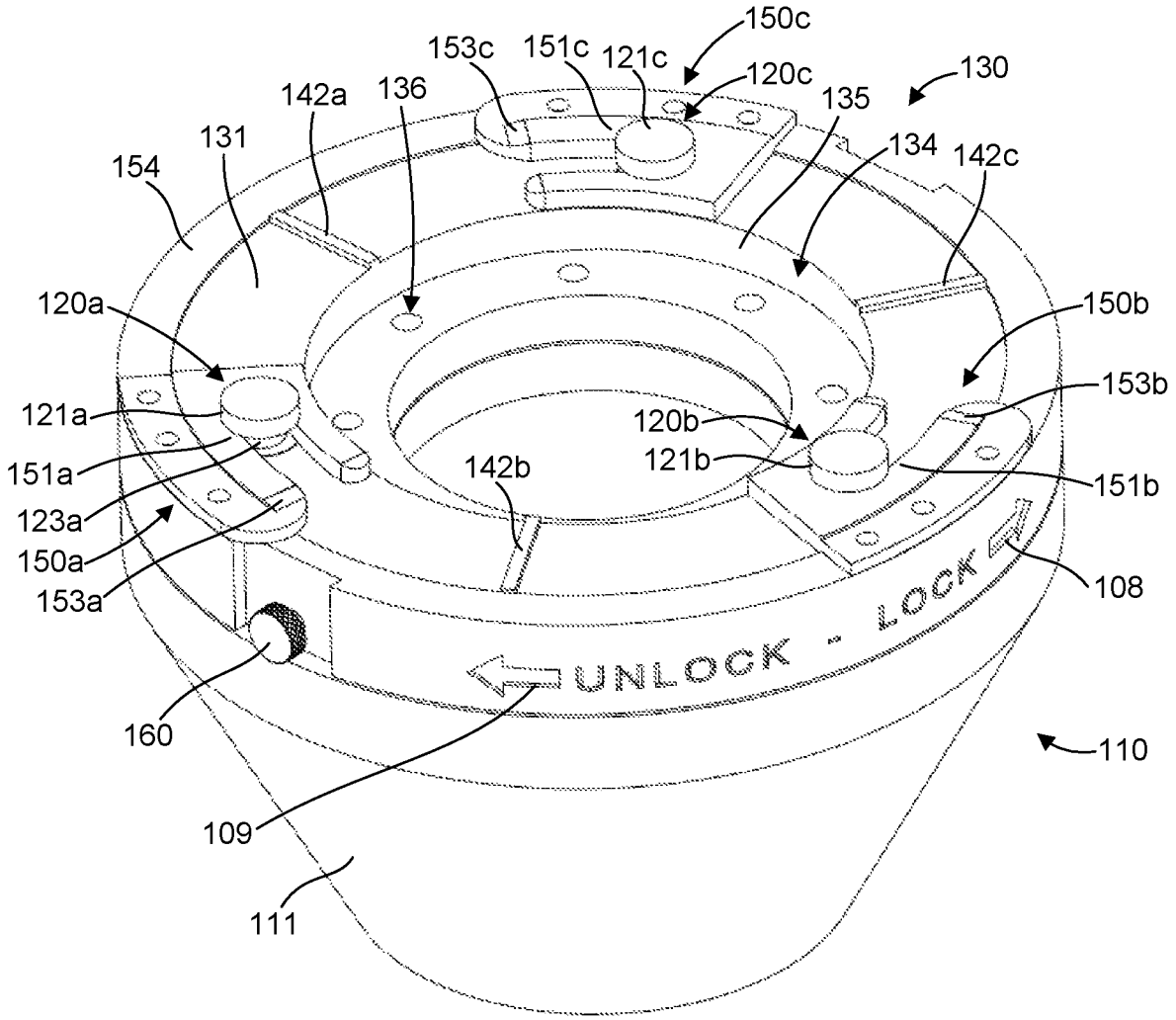
FIG. 3 is an assembled view of the stripper packer coupling assembly of FIG. 2 shown in a capture position in accordance with an example of the present disclosure.

To further describe the present technology, examples are now provided with reference to the figures. With reference to FIGS. 1-3, one example of a stripper packer system 100 is illustrated. The stripper packer system 100 can comprise a stripper packer coupling assembly 101 and a well drilling head component 102 (e.g., a rotary spindle of a bearing assembly or RCD). It should be understood that, depending on the particular equipment being used at a drilling head, a stripper packer at one well can be connected to equipment specific to that well while at another well a stripper packer can be connected to a different type of equipment. For example, at one well the stripper packer may be connected to a bearing assembly or RCD while at another well the stripper packer may be connected to an inner barrel or an accessory of the drilling head. While the present disclosure is presented in relation to connecting a stripper packer to a bearing assembly or RCD, the present technology contemplates facilitating connection of a stripper packer to any desired equipment of a drilling head.

The stripper packer coupling assembly 101 can include a connector 103 and a stripper packer (or just "packer") 110. The connector 103 can selectively connect the packer 110 to well drilling head equipment, such as the well drilling head component 102. Although the connector 103 is shown and described in the context of connecting a stripper packer to well drilling head equipment, it should be recognized that the connector 103 can be utilized in a wide variety of mechanical connection applications.

The packer 110 can be operable to receive a tubular or other drill hardware (not shown) and form a seal about the tubular. For example, the packer 110 can include a sealing portion or element 111 that forms a tubular opening 112 operable to receive a tubular. The tubular opening 112 defines a tubular opening axis 113, which may be parallel to a longitudinal axis 104 of a tubular (not shown) extending through the well drilling head component 102 and engaged with the packer 110 during use.

The connector 103 can include one or more coupling protrusions 120*a-c* and a capture mechanism 130. In the illustrated embodiment, the packer 110 can be adapted to include or be associated with the coupling protrusions 120*a-c* (i.e., the coupling protrusions 120*a-c* can be located and supported on, and can extend from, the packer 110), and the capture mechanism 130 can be adapted to be coupled to or associated with the well drilling head component 102. It should be recognized, however, that the packer 110 can include or be associated with the capture mechanism 130, and the coupling protrusions 120*a-c* can be coupled to or associated with the well drilling head component 102. Thus, generally, the stripper packer coupling assembly 101 can include the packer 110 and a well equipment mounting device that can be coupled to the well drilling head component 102 and operable to removably couple the packer 110 to the well drilling head component 102. Specifically, the packer 110 can include the coupling protrusions 120*a-c* or the capture mechanism 130, and the well equipment mounting device can comprise the other of the coupling protrusions 120*a-c* or the capture mechanism 130.

The capture mechanism 130 can include a guide member 131, which can have a primary opening 132 sized and configured to receive a tubular through the primary opening 132. The primary opening 132 can define a primary opening axis 133. In one aspect, the primary opening axis 133 can be parallel to and collinear with the tubular opening axis 113. The guide member 131 can also include an annular recess 134 about the primary opening 132, the annular recess 134 comprising a surface surrounding the primary opening 132, and the annular recess 134 being configured to receive and mate with a coupling portion 105 of the well drilling head component 102. A side wall 135 of the annular recess 134 can interface with an O-ring (not shown) in an O-ring groove 106 of the well drilling head component 102 to seal the junction between the well drilling head component 102 and the capture mechanism 130 against leakage of pressurized fluid having the potential to compromise the fluid containment of the drilling head.

The guide member 131 can include one or more fastener openings 136 formed in the surface of the annular recess 134 to facilitate coupling the capture mechanism 130 to the well drilling head component 102. The fastener openings 136 can be configured to align with fastener openings 107 in the coupling portion 105 of the well drilling head component 102. Fasteners (not shown) can extend through the fastener openings 136 in the guide member 131 and into the fastener openings 107 of the well drilling head component 102. The capture mechanism 130 may therefore be bottom-bolted to the well drilling head component 102 with bolts or screws oriented upward through the fastener openings 136, 107. The heads of the bolts or screws can be recessed in bolt head receptacle portions of the fastener openings 136 so as not to extend beyond flush with a bottom surface of the guide member 131.

The coupling protrusions 120*a-c* can have coupling heads 121*a-c*, respectively, that define capture interface surfaces. Capture interface surfaces 122*a*, 122*b* of the coupling protrusions 120*a*, 120*b*, respectively are shown in FIG. 1, but it is to be understood that coupling protrusion 120*c* can also comprise a capture interface surface even though this is not specifically shown. In some embodiments, the coupling protrusions 120*a-c* can each include a neck 123*a-c* in support of the respective coupling heads 121*a-c*, wherein the necks 123*a-c* at least partially define the capture interface surfaces 122*a-c*. In one aspect, the coupling protrusions 120*a-c* can be coupled to a base 124 of the stripper packer 110, which can provide support for the coupling protrusions 120*a-c*. The protrusions 120*a-c* can be coupled to the base 124 in any suitable manner, such as with a weld, a braze, a threaded connection, integrally formed in a monolithic structure, and others as will be recognized by those skilled in the art.

In addition, the base 124 can be coupled to the sealing portion 111 of the packer 110 to include or associate the coupling protrusions 120*a-c* with the packer 110. The base 124 can be coupled to the sealing portion 111 in any suitable manner. In some embodiments, the sealing portion 111 of the packer 110 can comprise a molded elastomeric material. In this case, the base 124 can be coupled to the sealing portion 111 during the molding process, for example, by being disposed at least partially within (i.e., embedded in) the sealing portion 111. One or more openings 125 in the base 124 can be at least partially filled with elastomeric material and provide surface area and structure for engaging with the elastomeric sealing portion 111 material to enhance or facilitate a secure coupling between the base 124 and the sealing portion 111. In still other examples, the base 124 can be secured to the sealing portion 111 using fasteners or adhesives. In addition, any combination of these means or methods can be employed.

The guide member 131 can also have one or more guide openings 140*a-c* configured to receive the respective coupling protrusions 120*a-c* and their respective coupling heads 121*a-c*. Each of the guide openings 140*a-c* can define a guide opening axis 141*a-c*, respectively. In one aspect, the guide openings 140*a-c* can be configured to receive the respective coupling protrusions 120*a-c* and their respective coupling heads 121*a-c* in a direction parallel to the guide opening axes 141*a-c*. In one aspect, the guide opening axes 141*a-c* can be parallel to the primary opening axis 133 and/or the tubular opening axis 113.

The capture mechanism 130 can also include one or more capture members 150*a-c* adapted and configured to receive the coupling protrusions 120*a-c*, respectively, and capture the respective coupling heads 121*a-c* and prevent movement of the coupling protrusions 120*a-c* out of the guide openings 140*a-c*. Each of the capture members 150*a-c* can define a capture interface surface 151*a-c*, respectively. The capture interface surfaces 122*a-c* of the respective coupling heads 121*a-c* and the capture interface surfaces 151*a-c* of the respective capture members 150*a-c* can be configured to engage or interface with one another. The capture interface surfaces 122*a-c*, 151*a-c* can comprise any suitable configuration. In one aspect, the capture interface surfaces 122*a-c*, 151*a-c* can be configured to slidingly interface with one another (e.g., they can each comprise a flat or planar surface configuration designed to engage and mate with one another).

In one example, as shown, the capture members 150*a-c* can comprise a bracket or bracket configuration having slots 152*a-c* formed therein, respectively, configured to receive the necks 123*a-c* of the respective coupling heads 121*a-c* to facilitate engagement of the capture interface surfaces 122*a-c*, 151*a-c*. The slots 152*a-c* can provide interface surface engagement and support on multiple sides of the coupling heads 121*a-c*, although such a configuration is not necessary, and adequate interface surface engagement and support can be provided without a slot structure. Engagement of the capture interface surfaces 122*a-c*, 151*a-c* can also be facilitated by ramped leading surfaces 153*a-c* of the respective capture members 150*a-c*, which facilitate alignment and insertion of the coupling heads 121*a-c* into the slots 152*a-c*, and prevent the coupling heads 121*a-c* from catching on the leading surfaces of the capture members 150*a-c*.

Although the coupling protrusions 120*a-c* and the guide openings 140*a-c* have a generally cylindrical shape and circular cross-section, it should be recognized that these components can have any suitable shape and configuration, such as a generally cuboid shape and square cross-section. Additionally, although the illustrated embodiment shows three each of the coupling protrusions 120*a-c*, the guide openings 140*a-c*, and the capture members 150*a-c* equally spaced apart, it should be recognized that the present technology is not limited to a particular number or arrangement of coupling protrusions, guide openings, or capture members, as any suitable number or arrangement can be utilized. Typically, two or more of each of the coupling protrusions, guide openings, and capture members in an equally spaced apart relationship will be utilized.

The capture members 150*a-c* and the guide member 131 can be moveable relative to one another, wherein the coupling protrusions 120*a-c* and the capture members 150*a-c* are moveable relative to one another, such that the stripper packer coupling assembly 101 comprises a capture or "lock" position and a release or "unlock" position. FIG. 2 shows the stripper packer coupling assembly 101 in the release position, with the capture members 150*a-c* and the guide member 131 positioned relative to one another, such that the guide openings 140*a-c* are positioned outside or away from the slot 152*a-c* of the capture members 150*a-c* to allow the coupling protrusions 120*a-c* to be inserted and received within the guide openings 140*a-c*. FIG. 2 also shows the packer 110 separated from the capture mechanism 130. In the release position, the capture members 150*a-c* facilitate passage of the coupling heads 121*a-c* through the guide openings 132*a-c*, such that the coupling heads 121*a-c* can be in a position to be inserted into the slots 152*a-c* upon movement of the capture members 150*a-c* and the guide member 131 relative to one another in a direction to cause the coupling heads 121*a-c* to be received within the slots 152*a-c*, wherein the stripper packer coupling assembly 101 is in the capture position. FIG. 3 shows the stripper packer coupling assembly 101 and the capture members 150*a-c* with the coupling protrusions 120*a-c* in the capture position, with the packer 110 assembled with, or coupled to, the capture mechanism 130. In the capture position, the capture interface surfaces 151*a-c* of the capture members 150*a-c* are operable to engage the capture interface surfaces 122*a-c* of the coupling heads 121*a-c* to mechanically interfere with passage of the coupling heads 121*a-c* through the guide openings 132*a-c*.

In one aspect, the capture members 150*a-c* can be operably coupled to one another, such that the capture members 150*a-c* can be simultaneously moved relative to the guide member 131 and the coupling protrusions 120*a-c* between the capture position and the release position. For example, in some embodiments, the capture mechanism 130 can include a capture ring 154 rotatably coupled to the guide member 131 and rotatable about the primary opening axis 133 and/or the tubular opening axis 113. The capture members 150*a-c* can be coupled to, and movable with, the capture ring 154 to facilitate engagement and disengagement of the capture interface surfaces 122*a-c*, 151*a-c* by rotation of the guide member 131 and the capture ring 154 relative to one another. The capture ring 154 can be rotatably coupled to the guide member 131 in any suitable manner. For example, the capture ring 154 can be disposed about an outer perimeter surface of the guide member 131. Interfacing surfaces of the capture ring 154 and the guide member 131 can be configured to facilitate sliding contact between the components. In one aspect, the capture members 150*a-c* can support the capture ring 154 about the guide member 131. In another aspect, the capture ring 154 can extend under a portion of the guide member 131, which in combination with the capture members 150*a-c* on a top side of the guide member 131 can secure the capture ring 154 about the guide member 131.

In some embodiments, the capture ring 154 can be configured to rotate the capture members 150*a-c* between the capture position and the release position, such as about the primary opening axis 133 and/or the tubular opening axis 113. For example, the guide member 131, which can be coupled to the well drilling head component 102, may be rotationally fixed or stationary during installation/removal of the packer 110. The capture ring 154 can rotate in a direction 108 (labeled "lock") to position the capture members 150*a-c* in the capture position. The capture ring 154 can rotate in an opposite direction 109 (labeled "unlock") to position the capture members 150*a-c* in the release position. Blind or closed ends of the slots 152*a-c* can provide a positive mechanical stop against the coupling protrusions 120*a-c* to limit movement of the capture ring 154 when the capture members 150*a-c* are fully in the capture position. In one aspect, the guide member 131 can include one or more rotational stops 142*a-c* configured to provide a mechanical stop against the capture members 150*a-c* to limit movement of the capture ring 154 when the capture members 150*a-c* are fully in the release position. Typically, the capture ring 154 can be rotated manually between the capture and release positions to facilitate operating the capture mechanism 130 without the use of tools.

Although the capture members 150*a-c* are shown in the illustrated example and described as moving or rotating about the primary opening axis 133 and/or the tubular opening axis 113 between the capture and release positions, it should be recognized that the capture members 150*a-c* can move in any suitable direction (e.g., a translational and/or a rotational direction) between the capture and release positions. For example, the capture members 150*a-c* in the illustrated example rotate in a plane perpendicular to the primary opening axis 133 and/or the tubular opening axis 113. In one example, capture members 150*a-c* can rotate about the respective guide opening axes 141*a-c*. In some examples, capture members 150*a-c* can translate in a plane perpendicular to the primary opening axis 133 and/or the tubular opening axis 113. In a particular example, capture members 150*a-c* can translate in a radial direction relative to the primary opening axis 133 and/or the tubular opening axis 113. In another particular example, capture members 150*a-c* can translate in a tangential direction relative to a circle centered on the primary opening axis 133 and/or the tubular opening axis 113. In some examples, the capture members 150*a-c* can be moved between the capture and release positions in a direction excluding rotation about an axis perpendicular to a guide opening axis. In other words, the capture members 150*a-c* can be moved between the capture and release positions in any direction that is not rotation about an axis perpendicular to the guide opening axes 141*a-c*.

Referring again to FIGS. 1-3, in one aspect, the guide member 131 can include an O-ring groove 137 (FIG. 1) to receive an O-ring (not shown). The base 124 can include a seal surface 126 (FIG. 2) configured to interface with an O-ring in the O-ring groove 137 of the guide member 131. The seal surface 126 can be located inboard of the coupling protrusions 120*a-c*. When moving to the capture position, the ramped leading surfaces 153*a-c* of the capture members 150*a-c* can force the coupling heads 121*a-c* upward, thus forcing the seal surface 126 closer to the underside of the guide member 131 and compressing an O-ring disposed in the O-ring groove 137. Thus, action to couple or secure the packer 110 to the well drilling head component 102 can also draw the packer 110 against the capture mechanism 130 and compress an O-ring. This can establish and seal the junction between the packer 110 and the capture mechanism 130 against leakage of pressurized fluid and compromising the fluid containment of the drilling head.

Figure 4:
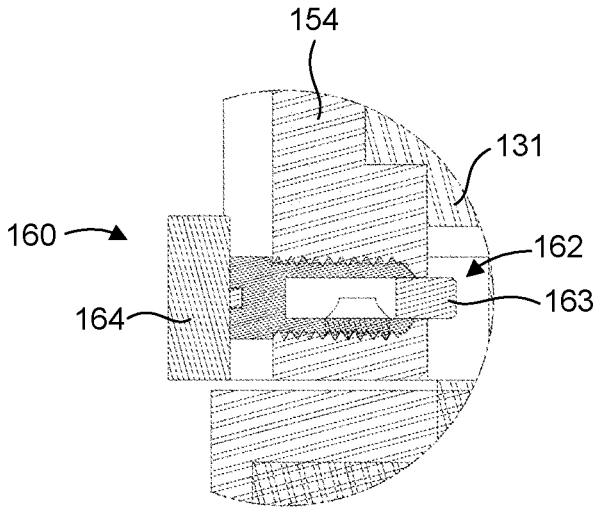
FIG. 4 is a detailed cross-sectional view of a retention pin of the stripper packer system of FIG. 1, in accordance with an example of the present disclosure.

In some embodiments, movement of the capture members 150*a-c* from the capture position to the release position can be selectively prevented or allowed. For example, one or more retention pins 160 can be included that are operable with the capture ring 154 and the guide member 131 to selectively allow or prevent movement of the capture ring 154 relative to the guide member 131. Although two retention pins 160 are shown in the illustrated embodiment, any suitable number of retention pins can be utilized. The retention pin 160 can be disposed in a retention pin opening 161 (FIG. 2) of the capture ring 154. As shown in FIG. 4, the guide member 131 can have a retention pin receptacle 162 to receive the retention pin 160 (e.g., a tip 163 of the retention pin 160) and provide mechanical interference to relative movement of the capture ring 154 and the guide member 131. The retention pin 160 can be movable into and out of the retention pin receptacle 162 within the retention pin opening 161 to alternately restrict or allow relative movement of the capture ring 154 and the guide member 131.

The tip 163 of the retention pin 160 can be maintained in, or moved out of, the retention pin opening 161 by any suitable device or structure. For example, the retention pin 160 can be threadingly engageable with the capture ring 154 and/or the guide member 131. In the illustrated embodiment, the retention pin 160 can be threadingly engaged with the retention pin opening 161 of the capture ring 154. In one aspect, a retention pin head 164 of the retention pin 160 can be configured for manual grasping (e.g., knurling, a knob, lever, etc.). In this case, the retention pin 160 can be configured for manual disengagement, which can facilitate manual operation of the capture mechanism 130. In addition, or as an alternative, the retention pin head 164 can include interface features to facilitate engagement with a tool, such as any suitable wrench.

A retention pin can have any suitable configuration. In one embodiment, a retention pin can be spring-loaded and movably coupled to the capture ring 154 and biased toward the guide member 131. In this case, spring force is operable to maintain a tip of the retention pin in the retention pin receptacle 162. The retention pin can be removed from the retention pin receptacle 162 by overcoming the spring force, which can be accomplished manually and without the use of tools.

In one aspect, torque acting on the packer 110 from a tubular during use can be transferred between the coupling protrusions 120*a-c* and sidewalls of the guide openings 140*a-c* in the guide member 131. Thus, the capture members 150*a-c* are not in the torque load path between the tubular and the well drilling head component 102. As a result, the capture members 150*a-c* are not required to transfer torque and are therefore subjected substantially only to axial loading during operation. The capture members 150*a-c* can therefore maintain a capture function regardless of the rotational direction or loading of the tubular. The capture ring 154 and retention pins 160 are likewise outside the torque load path between the tubular and the well drilling head component 102. As a result, the retention pin 160 need only be configured to withstand minimal loading to prevent movement of the capture ring 154 relative to the guide member 131.

In accordance with one embodiment of the present invention, a method is disclosed for facilitating coupling of a stripper packer to well drilling head equipment. The method can comprise providing a packer operable to receive a tubular therethrough and form a seal about the tubular. The packer can comprise a plurality of coupling protrusions or a capture mechanism. The method can also comprise providing a well equipment mounting device operable to mount to a well drilling head component and removably couple the packer to the well drilling head component. The well equipment mounting device can comprise the other of the coupling protrusion or the capture mechanism. Each coupling protrusion can have a coupling head defining a first capture interface. The capture mechanism can comprise a guide member having a plurality of guide openings, each guide opening operable to receive one of the plurality of coupling heads therein, and a plurality of capture members, each capture member defining a second capture interface. Additionally, the method can comprise facilitating simultaneous movement of the plurality of capture members relative to the guide member and the plurality of coupling protrusions between a capture position and a release position. In the release position, the plurality of capture members can facilitate passage of the plurality of coupling heads through the plurality of guide openings. In the capture position, the second capture interface surfaces of the plurality of capture members can be operable to engage the first capture interface surfaces of the plurality of coupling heads to mechanically interfere with passage of the coupling heads through the guide openings. It is noted that no specific order is required in this method, though generally in one embodiment, these method steps can be carried out sequentially.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A connector for selectively connecting a stripper packer to well drilling head equipment, the connector comprising:

a coupling protrusion having a coupling head defining a first capture interface surface; and a capture mechanism comprising a guide member having a guide opening defining a guide opening axis, the guide opening being operable to receive the coupling head in a direction parallel to the guide opening axis, the guide member further comprising a primary opening to receive a tubular, the primary opening defining a primary opening axis, a capture member defining a second capture interface surface, the capture member being movable relative to the guide member and the coupling protrusion between a capture position and a release position in a direction excluding rotation about an axis perpendicular to the guide opening axis, and a capture ring rotatably coupled to the guide member and rotatable about the primary opening axis, wherein the capture member is coupled to, and movable with, the capture ring, which is operable to rotate the capture member between the capture position and the release position, wherein, in the release position, the capture member facilitates passage of the coupling head through the guide opening, and wherein, in the capture position, the second capture interface surface of the capture member is operable to engage the first capture interface surface of the coupling head to mechanically interfere with passage of the coupling head through the guide opening.

2. The connector of claim 1, wherein the guide opening axis is parallel to the primary opening axis.

3. The connector of claim 1, wherein the guide member comprises one or more fastener openings to facilitate coupling the capture mechanism to well drilling head equipment.

4. The connector of claim 1, wherein the capture member comprises a plurality of capture members, and the coupling protrusion comprises a plurality of coupling protrusions.

5. The connector of claim 1, wherein the coupling protrusion comprises a neck in support of the coupling head, and the capture member comprises a slot operable to receive the neck.

6. The connector of claim 1, wherein the capture member comprises a ramped leading surface to facilitate engagement of the second capture interface surface with the first capture interface surface.

7. A stripper packer coupling assembly, comprising:

a packer operable to receive a tubular therethrough and form a seal about the tubular, the packer comprising a coupling protrusion or a capture mechanism; and a well equipment mounting device operable to mount to a well drilling head component and removably couple the packer to the well drilling head component, the well equipment mounting device comprising the other of the coupling protrusion or the capture mechanism, the coupling protrusion having a coupling head defining a first capture interface surface, the capture mechanism comprising a guide member having a guide opening defining a guide opening axis, the guide opening being operable to receive the coupling head in a direction parallel to the guide opening axis, and a capture member defining a second capture interface surface, the capture member being movable relative to the guide member and the coupling protrusion between a capture position and a release position in a direction excluding rotation about an axis perpendicular to the guide opening axis, wherein, in the release position, the capture member facilitates passage of the coupling head through the guide opening, and wherein, in the capture position, the second capture interface surface of the capture member is operable to engage the first capture interface surface of the coupling head to mechanically interfere with passage of the coupling head through the guide opening.

8. The stripper packer coupling assembly of claim 7, wherein the packer comprises a tubular opening operable to receive the tubular therethrough, the tubular opening defining a tubular opening axis.

9. The stripper packer coupling assembly of claim 8, wherein the guide opening axis is parallel to the tubular opening axis.

10. The stripper packer coupling assembly of claim 8, wherein the capture mechanism comprises a capture ring rotatably coupled to the guide member and rotatable about the tubular opening axis, and wherein the capture member is coupled to, and movable with, the capture ring, which is operable to rotate the capture member between the capture position and the release position.

11. The stripper packer coupling assembly of claim 7, wherein the guide member comprises a primary opening to receive the tubular.

12. The stripper packer coupling assembly of claim 7, wherein the guide member comprises one or more fastener openings to facilitate coupling the well equipment mounting device to the well drilling head component.

13. The stripper packer coupling assembly of claim 7, wherein the capture member comprises a plurality of capture members, and the coupling protrusion comprises a plurality of coupling protrusions.

14. The stripper packer coupling assembly of claim 7, wherein the coupling protrusion comprises a neck in support of the coupling head, and the capture member comprises a slot operable to receive the neck.

15. The stripper packer coupling assembly of claim 7, wherein the capture member comprises a ramped leading surface to facilitate engagement of the second capture interface surface with the first capture interface surface.

16. The stripper packer coupling assembly of claim 7, wherein the packer comprises a sealing portion that forms the tubular opening, and the packer comprises a base in support of the coupling protrusion, the base being coupled to the sealing portion.

17. The stripper packer coupling assembly of claim 16, wherein the base is disposed at least partially within the sealing portion.

18. A method for facilitating coupling of a stripper packer to well drilling head equipment, the method comprising:

providing a packer operable to receive a tubular therethrough and form a seal about the tubular, the packer comprising a plurality of coupling protrusions or a capture mechanism;

providing a well equipment mounting device operable to mount to a well drilling head component and removably couple the packer to the well drilling head component, the well equipment mounting device comprising the other of the coupling protrusion or the capture mechanism, each coupling protrusion having a coupling head defining a first capture interface, the capture mechanism comprising a guide member having a plurality of guide openings, each guide opening operable to receive one of the plurality of coupling heads therein in a direction parallel to a guide opening axis, and a plurality of capture members, each capture member defining a second capture interface; and facilitating simultaneous movement of the plurality of capture members relative to the guide member and the plurality of coupling protrusions between a capture position and a release position, wherein, in the release position, the plurality of capture members facilitate passage of the plurality of coupling heads through the plurality of guide openings, and wherein, in the capture position, the second capture interface surfaces of the plurality of capture members are operable to engage the first capture interface surfaces of the plurality of coupling heads to mechanically interfere with passage of the coupling heads through the guide openings.

19. A connector for selectively connecting a stripper packer to well drilling head equipment, the connector comprising:

a coupling protrusion having a coupling head defining a first capture interface surface; and a capture mechanism comprising a guide member having a guide opening defining a guide opening axis, the guide opening being operable to receive the coupling head in a direction parallel to the guide opening axis, the guide member further comprising a primary opening to receive a tubular, the primary opening defining a primary opening axis, a capture member defining a second capture interface surface, the capture member being movable relative to the guide member and the coupling protrusion between a capture position and a release position, and a capture ring rotatably coupled to the guide member and rotatable about the primary opening axis, wherein the capture member is coupled to, and movable with, the capture ring, which is operable to rotate the capture member between the capture position and the release position, wherein, in the release position, the capture member facilitates passage of the coupling head through the guide opening, and wherein, in the capture position, the second capture interface surface of the capture member is operable to engage the first capture interface surface of the coupling head to mechanically interfere with passage of the coupling head through the guide opening.

* * * * *